United States Patent [19]

Biela

[11] 4,295,480

[45] Oct. 20, 1981

[54] COMB AND THE METHOD OF MAKING SAME

[75] Inventor: John A. Biela, Niles, Ill.

[73] Assignee: Jerome D. Schiffman, deceased, late of Wilmette, Ill.

[21] Appl. No.: 763,280

[22] Filed: Jan. 27, 1977

[51] Int. Cl.[3] ..... A45D 24/00

[52] U.S. Cl. ..... 132/151

[58] Field of Search ..... 132/11, 145, 151, 152, 132/163, 109; 29/433, 434; 264/138

[56] References Cited

U.S. PATENT DOCUMENTS

| | | | |
|---|---|---|---|
| 1,330,675 | 2/1920 | Besson | 132/151 |
| 2,808,062 | 10/1957 | Schiffman | 132/151 |
| 3,855,689 | 12/1974 | Schiffman | 132/151 |

*Primary Examiner*—G. E. McNeill

*Attorney, Agent, or Firm*—Bernard L. Kleinke

[57] ABSTRACT

A comb includes a hollow frame having a pair of fixed teeth at opposite ends thereof, and a cap having a depending body portion disposed within the hollow interior of the frame. A series of transversely extending open slots in one longitudinally extending side planar face of the body portion receives individually a series of axially rotatable rod-like teeth. Each one of the open slots is four-sided in cross-sectional shape, and the fourth side is open in the plane of the face. The depth of the slots is greater than the thickness of the teeth so that the teeth fit entirely within the slots. In one embodiment of the present invention, the teeth are made by rotating axially rod stock and moving a cutter having the configuration of the desired shape of the teeth into cutting engagement with the rod stock. In another embodiment of the present invention, the teeth are formed from rod stock placed in a cavity having the shape of the body portion of the teeth to be formed, and then moving a die axially into engagement with one end of the rod stock to cause the rod stock to flow into the shape of the desired tooth.

4 Claims, 6 Drawing Figures

FIG. 1
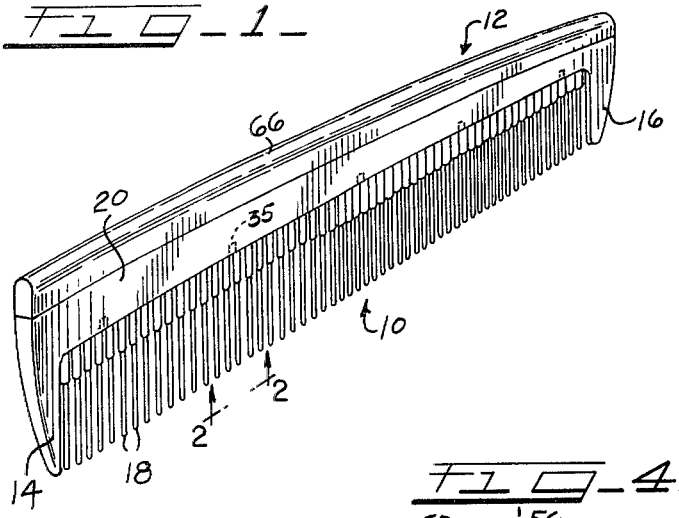
FIG. 3
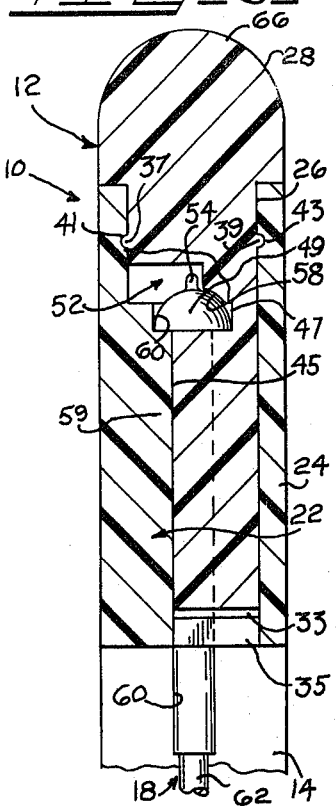
FIG. 4
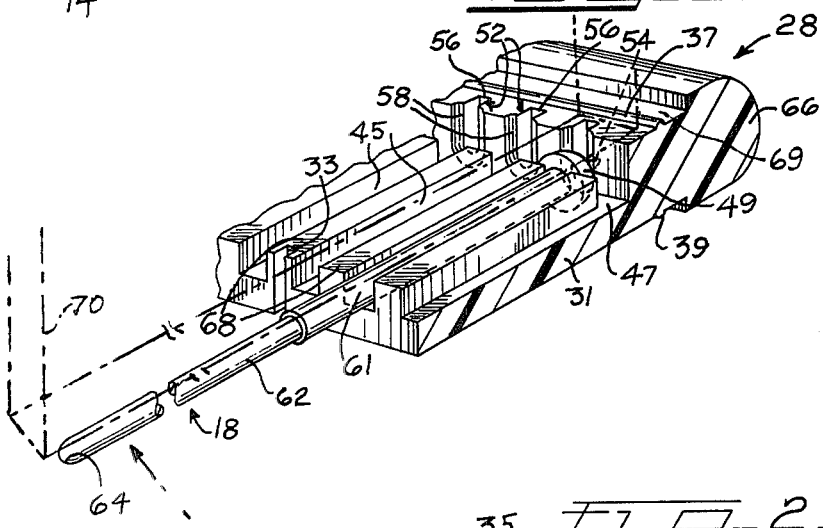
FIG. 2
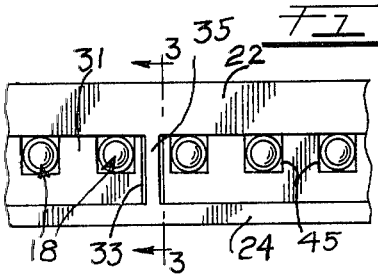
FIG. 6
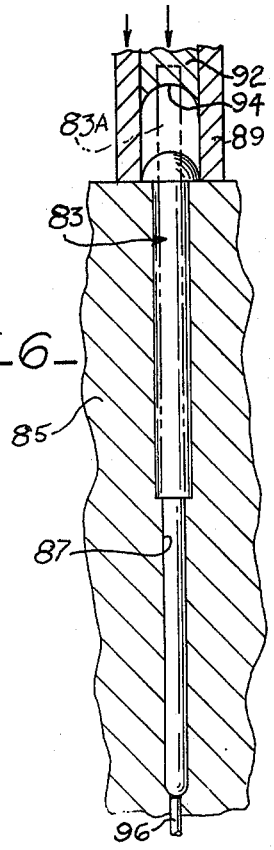
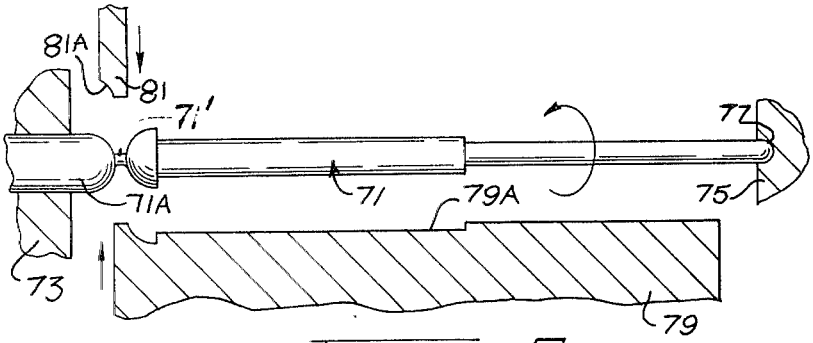
FIG. 5

COMB AND THE METHOD OF MAKING SAME

The present invention relates in general to a hair comb and a method of making it, and it more particularly relates to a hair comb which has teeth individually and freely rotatable about their axes, together with a method of making such a comb.

Combs having axially rotatable teeth have been disclosed in U.S. Pat. Nos. 2,808,062 and 3,855,689. Such combs have many desirable advantages and features, including a self-cleaning action which occurs during use. While such combs as disclosed in the foregoing-mentioned patents are suitable for some applications, it would be highly desirable to have such a comb having axially rotatable teeth, which comb would be relatively inexpensive to manufacture in mass production techniques. In this regard, while the combs disclosed in the foregoing-mentioned patents have many desirable advantages and features, for mass production purposes, it is somewhat time consuming to position individually each one of the teeth into the hollow frame for supporting the teeth. In this regard, it would be highly desirable to have such a comb which could be rapidly assembled in an efficient manner in such a way that the teeth could be assembled to the hollow frame in a rapid and efficient manner for mass production purposes. Also, it would be highly desirable to have a method of making such a comb in a relatively inexpensive manner, and yet have rigid metal teeth for the comb, which teeth should be relatively inexpensive to manufacture.

Therefore, the principal object of the present invention is to provide a new and improved comb having axially rotatable teeth and a method of making the comb, wherein the teeth of the comb are manufactured by a relatively inexpensive technique and the thus formed teeth are quickly and easily assembled in a hollow frame for the comb to facilitate the insertion of the teeth into the hollow frame.

Briefly, the above and further objects are realized in accordance with the present invention by providing a comb having an elongated hollow frame, and a cap having a depending body portion disposed within the hollow interior of the frame. A series of transversely extending open slots are disposed in one longitudinally extending side planar face of the body portion for receiving individually a series of axially rotatable rod-like teeth. Each one of the open slots is four-sided in cross-sectional shape, and the fourth side is open in the plane of the face. The depth of the slots is greater than the thickness of the teeth so that the teeth fit entirely within the slots. By having open slots in one side face of the body portion and by having the depth of the slots being greater than the thickness of the teeth, a hopper device can be moved across and above the openings to the slots to drop seriatum teeth individually into the open slots to facilitate greatly the mass production of the comb. According to one embodiment of the present invention, the teeth can be made of metal rod stock, and the rod stock can be rotated axially. Cutting tools bearing the configuration of the desired tooth are moved into engagement with the rotating rod stock to form the desired tooth for the comb. According to another embodiment of the present invention, the tooth is also formed from metal rod stock, and the rod stock is disposed within a cavity having the shape of the body portion of the tooth to be formed. A die is then moved downwardly under force to cause the rod stock to assume the desired shape of the tooth.

These and further objects of the present invention will be understood more fully and completely from the following detailed description when considered with reference to the accompanying drawings, wherein:

FIG. 1 is a pictorial view of a hair comb which is constructed in accordance with the present invention;

FIG. 2 is an enlarged cross-sectional view of a portion of the underside of the comb of FIG. 1 taken substantially along the line 2—2 thereof;

FIG. 3 is a greatly enlarged cross-sectional view of the comb of FIG. 2 taken substantially along the line 3—3 thereof;

FIG. 4 is a fragmentary cross-sectional pictorial view of the cap for the comb of FIG. 1, illustrating it with one of the teeth disposed within the open slot in the cap;

FIG. 5 is a cross-sectional fragmentary view of a technique for making the teeth for the comb of FIG. 1 in accordance with the present invention; and FIG. 6 is a cross-sectional fragmentary view of another technique for making the teeth for the comb in FIG. 1 in accordance with the present invention.

Referring now to the drawings and more particularly to FIG. 1 thereof, there is shown a hair comb 10, which is constructed in accordance with the present invention. The comb 10 generally comprises a hollow frame 12 open at both of its top and bottom and closed at its opposite ends at a pair of fixed teeth 14 and 16. A series of axially rotatable teeth 18 are arranged in a side-by-side manner in a common plane between the fixed teeth 14 and 16, the teeth 18 extending from the hollow interior of the frame 12. The axially rotatable teeth 18 are self-cleaning due to their rotating action during use. Also, such axially rotatable teeth slip more easily and readily through the hair during a combing operation, thereby avoiding or at least minimizing snarls and tangling of the hair.

Considering now the frame 12 in greater detail, the frame 12 includes a body portion 20 (FIG. 1) having a front wall 22 and a rear wall 24 defining a hollow interior 26. A cap 28 has a depending body portion 31 which fits into the hollow interior 26 to close off the upper surface of the frame in a smoothly contoured manner as best seen in FIGS. 1 and 3 of the drawings. A series of notches, such as the notch 33 shown in FIGS. 3 and 4 of the drawings, receive individually a series of stiffening webs 35 interconnecting the front wall 22 and the rear wall 24 of the body portion 20. A pair of lengthwise extending beads 37 and 39 on opposite sides of the depending body 31 of the cap 28 snap into engagement with a pair of complementary-shaped grooves 41 and 43 extending lengthwise on the inside surfaces of the respective walls 22 and 24 to securely hold the cap 28 in position to the body portion 20 as best seen in FIGS. 3 and 4 of the drawings.

As best seen in FIGS. 2 and 4 of the drawings, a series of transversely extending open slots are disposed in the body 31 of the cap 28 for receiving the body portion of the axially rotatable teeth 18. The slots 45 are four-sided, and more particularly they are square in cross section throughout their length. A lengthwise extending open slot 47 is disposed in the depending body 31 of the cap 28, each one of the slots 45 opening into the lengthwise slot 47. Each one of the axially rotatable teeth 18 includes an enlarged head portion 49 which fits into the lengthwise slot 47.

A series of cavities 52 open into the lengthwise slot 47 and are disposed opposite the teeth receiving slots 45. The cavities 52 receive axially-extending stubs, such as the stub 54 shown in FIG. 3 of the drawings, projecting from the central portions of the heads 49 of the teeth 18. The cavities 52 include a cylindrical portion 56 (FIG. 4) for receiving the stub 54 in a loose manner so that the stubs do not interfere with the free rotation of the teeth. A series of smoothly-contoured portions 58 of the cavities 52 open outwardly into the lengthwise slot 47 and at their upper portions communicate with the cylindrical portions 56, whereby the contoured portions 58 serve as bearing surfaces for the respective heads 59 of the teeth 18.

Each one of the teeth receiving slots 45 is square in cross section through its length and has one of its square sides open. A projecting portion 59 of the front wall 22 engages and covers over the open sides of the slots 45 as best seen in FIG. 3 of the drawings. As a result, as shown in FIG. 2 of the drawings, the teeth 18 each has a four-point contact in the square slots 45. With such an arrangement, there is always open spaces surrounding the teeth 18 so that debris cannot collect in the slots 45 and eventually cause the teeth 18 to lock up or at least not remain in a freely rotatably condition. Thus, the teeth 18 in accordance with the present invention have a very low friction engagement with the depending body 31 of the cap 28 and the projection 59 of the front wall 22.

A series of smoothly-contoured cavities in the upper portion of the projection 59 receives individually the front portions of the heads 49 of the teeth 18 to serve as bearing surfaces therefor.

Considering now the teeth 18 in greater detail, the teeth 18 are all similar to one another, and therefore only the tooth shown in FIG. 4 of the drawings will now be described. The tooth 18 includes a cylindrical body 61 and a reduced diameter portion 62 terminating in a smoothly rounded blunt end 64. The cylindrical body 61 is disposed entirely within its slot 45, since the depth of the slots 45 is at least slightly greater than the diameter of the body portions of the teeth 18.

Considering now the cap 28 in greater detail with reference to FIGS. 3 and 4 of the drawings, the cap 24 has an upper rounded end portion 66. A planar surface of one side face of the body portion 31 has the slots 45 disposed therein. In this regard, one of the four sides of the slots 45 is disposed in the plane of the surface 68. Similarly, a planar surface 69 (FIG. 4) has the bead 37 projecting therefrom and has the cavities 52 extending therein. It should be noted that the plane of the surface 69 is disposed forwardly of the plane of the surface 68, since the heads 49 of the teeth 18 extend forwardly beyond the slots 45 within the lengthwise slot 47.

In accordance with the present invention, in order to facilitate the mass production of the comb 10, as shown in FIG. 4 of the drawings, a hopper chute 70 shown in phantom lines, enables the teeth 18 to be loaded into the slot 45 in a rapid and efficient manner. In this regard, the teeth 18 can be stacked in a vertical manner within the hopper chute 70 with the teeth 18 being disposed one on top of the other. The mouth of the chute 70 is then disposed in alignment with the first one of the empty slots 45. The mouth of the chute 70 is disposed in the plane of the surface 69 and may be disposed slightly thereabove or even resting thereon. The chute 70 is then in position to drop the first one of the teeth 18 under the force of gravity into the first empty slot 45. Thereafter, the chute 70 can move in a lengthwise direction relative to the cap 28 until the mouth of the chute 70 is disposed opposite the adjacent empty slot 45 whereby the next tooth 18 drops into the next adjacent empty slot 45. The chute 70 continues to be indexed to the next position until all of the slots 45 are filled with teeth 18.

By aligning the plane of the mouth of the chute 70 with the plane of the surface 69, the heads 49 and the stubs 54 of the teeth 18 can drop readily into the cavities 54. After dropping into the cavities 54 and thus the slots 45 align therewith, the chute is then free to move to the next empty slot 45 and empty cavity 52. Since the plane of the surface 69 is disposed forwardly of the head 49 when it is dropped into the lengthwise slot 47, the head 49 does not interfere with the movement of the chute 70.

After all of the teeth 18 are loaded into the slots of the cap 28, the body 31 of the cap 28 is then moved into the hollow interior 26 of the body 20 of the frame 12. Thus, as best seen in FIG. 3 of the drawings, the teeth 18 extend through the open bottom portion of the interior 26.

The body portion 20 of the frame 12 and the cap 28 are both molded from plastic material in the preferred form of the present invention. The teeth 18 are also composed preferably of molded plastic material. The stub 54 is a gate stub formed when the teeth are molded. The teeth may be composed of a rigid durable plastic material, such as Delrin or Valox.

By providing the cavity portion 56, the gate stub 54 does not interfere with the free rotation of the teeth 18. In this regard, if the gate stub were on the side of the teeth 18, adjacent gate stubs could contact one another and prevent rotation of the teeth 18.

Referring now to FIG. 5 of the drawings, there is shown a method of making an axially rotatable tooth 71, which is constructed in accordance with the present invention and which may be substituted for the teeth 18 in the comb 10 of FIG. 1 of the drawings. As shown in FIG. 5 of the drawings, a tooth 71 is formed out of a solid rod stock material so that the tooth 71 is composed of solid metal material.

The rod stock is mounted in a screw machine collet 73, and it is held at its opposite end against a stop 75 having a recess 77 therein. The rod stock is rotated axially in the direction of the arrow by means of the screw machine collet 75.

After rotating the rod stock, a cutting tool 79 having the desired configuration 79A of the tooth to be formed moves into engagement with the rotating rod stock to cut it away into the desired shape of the tooth. The cutting tool 79 shapes the rod stock, except for the tip end portion disposed within the recess 75 which is shaped when the previous tooth was formed by moving another cutting tool 81 having a configuration 81A into engagement with the rod stock to form a stub 71' (which is similar to the gate stub 54 of the plastic tube 18 of FIG. 1). Once the cutting tool 81 moves into engagement with the rod stock to complete the operation, the tip end of the next tooth 71A is formed and the stub 71' is severed to release the completed tooth 71, whereby the completed tooth 71 falls under the force of gravity into a storage container (not shown).

Thereafter, the rod stock is then advanced from the collet 73 until the finished front end portion of the rod stock moves into engagement with the stock 75.

Referring now to FIG. 6 of the drawings, there is shown another technique in accordance with the present invention for making solid metal teeth which may be substituted for the plastic teeth 18 of the comb 10 of FIG. 1. Rod stock is first cut into a series of similar rod-like members. Each one of the rod-like members, such as the rod-like member 83A, is inserted into a die 85 having a cavity 87 therein which has an internal configuration of the body portion and reduced diameter portion of the tooth 83. A sleeve 89 surrounding the rod stock 83A extending out of the cavity 87 is then disposed in contact with the die 85. A member 92 disposed within and axially aligned with the sleeve member 89 has a recess 94 in the shape of the semi-spherical head of the tooth 83. As a result, the recess 94 of the member 92 is moved into engagement with the rod stock 83A and forced toward the cavity 87. As a result, the rod-like member 83A flows into the shape of the tube 83, whereby the head of the tooth 83 is formed outside of the cavity 87 and the remaining portion of the tooth 83 is formed within the cavity 87. In such a manner, the rod-like member composed of metal material cold flows it to the desired shape of the tooth 83.

After the tooth 83 is thus formed, an ejector pin 96 at the bottom of the cavity 87 backs the completed tooth 83 out of the cavity 87 after the member 92 has retracted.

While the present invention has been described in connection with particular embodiments thereof, it will be understood that many changes and modifications of this invention may be made by those skilled in the art without departing from the true spirit and scope thereof. Accordingly, the appended claims are intended to cover all such changes and modifications as fall within the true spirit and scope of the present invention.

What is claimed is:

1. A comb, comprising:

an elongated hollow frame having front and rear walls and fixed end members for defining a hollow interior in said frame, said hollow interior having an elongated opening at the bottom thereof;

elongated means being disposed at least partially within said hollow interior in overlying engagement with the inside surface of said front and rear walls for closing the bottom opening in said frame and having a series of spaced-apart transversely extending openings;

a series of axially rotatable rod-like teeth having enlarged head and cylindrical body portions and disposed individually with their body portions within said openings and extending from said elongated means out of said hollow interior through the bottom opening thereof, said teeth receiving openings in said elongated means being larger in cross-sectional area than the cross-sectional area of said cylindrical body portions of said teeth so that said shank cylindrical body portions adjacent said head portions fit entirely within their openings and said head portions fitting thereabove, wherein each one of said teeth includes an enlarged head portion, each opening is a four-sided slot in cross-sectional shape, one of the sides being open and in the plane of said face, an open slot extending in a lengthwise direction in one side planar face of said elongated means for receiving enlarged head portions of said teeth.

2. A comb, comprising:

an elongated hollow frame having front and rear walls and fixed end members for defining a hollow interior in said frame, said hollow interior having an elongated opening at the bottom thereof;

elongated means being disposed at least partially within said hollow interior in overlying engagement with the inside surface of said front and rear walls for closing the bottom opening in said frame and having a series of spaced-apart transversely extending openings;

a series of axially rotatable rod-like teeth having enlarged head and cylindrical body portions and disposed individually with their body portions within said openings and extending from said elongated means out of said hollow interior through the bottom opening thereof, said teeth receiving openings in said elongated means being larger in cross-sectional area than the cross-sectional area of said cylindrical body portions of said teeth so that said shank cylindrical body portions adjacent said head portions fit entirely within their openings and said head portions fitting thereabove, wherein each one of the head portions of said teeth is semi-spherical, further including smoothly contoured cavity means opening into said hollow interior to serve as bearing surfaces for said head portions of said teeth, and wherein each one of said teeth includes an axially extending stub portion projecting from the head portion, further including a plurality of cylindrical cavities opening into respective ones of said contoured cavities for receiving the stubs of said teeth.

3. A comb, comprising:

an elongated hollow frame having front and rear walls and fixed end members for defining a hollow interior in said frame, said hollow interior having an elongated opening at the bottom thereof;

elongated means being disposed at least partially within said hollow interior in overlying engagement with the inside surface of said front and rear walls for closing the bottom opening in said frame and having a series of spaced-apart transversely extending openings;

a series of axially rotatable rod-like teeth having enlarged head and cylindrical body portions and disposed individually with their body portions within said openings and extending from said elongated means out of said hollow interior through the bottom opening thereof, said teeth receiving openings in said elongated means being larger in cross-sectional area than the cross-sectional area of said cylindrical body portions of said teeth so that said shank cylindrical body portions adjacent said head portions fit entirely within their openings and said head portions fitting thereabove, further including a series of spaced apart webs disposed within the hollow interior of said frame, wherein said member includes a series of lengthwise spaced-apart notches in its bottom edge for receiving individually said webs.

4. A comb, comprising:

an elongated hollow frame having front and rear walls and fixed end members for defining a hollow interior in said frame, said hollow interior having an elongated opening at the bottom thereof;

elongated means being disposed at least partially within said hollow interior in overlying engagement with the inside surface of said front and rear walls for closing the bottom opening in said frame and having a series of spaced-apart transversely extending openings;

a series of axially rotatable rod-like teeth having enlarged head and cylindrical body portions and disposed individually with their body portions within said openings and extending from said elongated means out of said hollow interior through the bottom opening thereof, said teeth receiving openings in said elongated means being larger in cross-sectional area than the cross-sectional area of said cylindrical body portions of said teeth so that said shank cylindrical body portions adjacent said head portions fit entirely within their openings and said head portions fitting thereabove, wherein said frame has a pair of fixed teeth at opposite ends thereof.

* * * * *